US010549439B2

(12) United States Patent
Basile et al.

(10) Patent No.: US 10,549,439 B2
(45) Date of Patent: Feb. 4, 2020

(54) HAND-OPERATED ROTARY BELT CUTTER

(71) Applicant: Ford Global Technologies, LLC, Dearborn, MI (US)

(72) Inventors: James M. Basile, Dundee, MI (US); Scott Willis, Gibraltar, MI (US); Joseph Alan Skrobowski, New Boston, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 164 days.

(21) Appl. No.: 15/426,833

(22) Filed: Feb. 7, 2017

(65) Prior Publication Data

US 2018/0222072 A1 Aug. 9, 2018

(51) Int. Cl.
*B26B 25/00* (2006.01)
*B26D 1/22* (2006.01)

(52) U.S. Cl.
CPC ..... *B26B 25/005* (2013.01); *B26B 25/002* (2013.01); *B26D 1/22* (2013.01); *B26D 1/225* (2013.01)

(58) Field of Classification Search
CPC ..... B26D 3/005; B26D 3/28; B26D 25/00; B26D 25/005; B26D 25/007; B26D 1/12; B26D 1/125; B26D 1/22; B26D 1/225; B26D 7/01; H02G 1/1217; H02G 1/1234; H02G 1/1239; H02G 1/1295; Y10S 83/935; B23B 25/00; B23B 25/005; B23B 25/007
USPC ..... 83/935, 951, 947, 872, 435, 436.45; 30/90.1–91.2, 92–108; 7/132, 134
See application file for complete search history.

(56) References Cited

U.S. PATENT DOCUMENTS 161,780 A * 4/1875 Hagerty ..... B23D 19/065 83/333
403,521 A * 5/1889 Cutlan ..... B27G 15/00 142/56
820,692 A * 5/1906 Aldous ..... B26B 25/00 30/265
1,686,044 A * 10/1928 Stott ..... H02G 1/1295 30/91.1
1,881,020 A * 10/1932 McFarland ..... B26D 1/24 30/265
2,031,470 A * 2/1936 Eck ..... H02G 1/1297 30/90.3
2,230,302 A * 2/1941 Leguillon ..... B26D 3/005 157/13

(Continued)

*Primary Examiner* — Jason Daniel Prone
*Assistant Examiner* — Samuel A Davies

(57) ABSTRACT

The disclosed inventive concept provides a rotary cutter and method of accurately cutting a ribbed transmission belt lengthwise to a desired width. The rotary cutter includes an upper portion having a handle end and a pivot end and a lower portion having a handle end and a pivot end. The pivot ends of each portion are joined by a common pivot. A belt input pulley and a rotary cutting wheel are rotatably attached to the upper portion. A drive wheel is rotatably attached to the lower portion. A belt output pulley is rotatably attached to the common pivot. Preferably but not absolutely the belt input pulley and the belt output pulley have ribbed outer surfaces. A cutting wheel cover is fixed around at least a portion of the cutting wheel. The upper portion is movable between an open, belt-fitting position and a closed, belt-cutting position relative to the lower portion.

17 Claims, 11 Drawing Sheets

(56) References Cited

U.S. PATENT DOCUMENTS 2,298,685 A * 10/1942 Davis ..... B26D 3/005 157/13
2,300,139 A * 10/1942 Stein ..... B23D 21/08 30/101
2,385,368 A * 9/1945 Montgomery ..... H01B 7/36 30/90.7
2,391,722 A * 12/1945 Lundeen ..... H02G 1/1217 30/90.9
2,502,245 A * 3/1950 Charles ..... H02G 1/1217 30/319
2,527,082 A * 10/1950 Salas ..... C14B 5/00 30/178
2,589,471 A * 3/1952 Ayers ..... H02G 1/1217 30/90.9
3,543,616 A * 12/1970 Bradley ..... H02G 1/1295 30/90.9
3,575,329 A * 4/1971 Hannabery ..... B26D 1/245 225/103
4,072,072 A * 2/1978 Harb ..... B26D 1/24 157/13
4,096,772 A * 6/1978 Hall ..... B26D 1/02 157/13
4,267,757 A * 5/1981 Frantz ..... H02G 1/1295 83/464
4,322,916 A 4/1982 Richmond
4,368,656 A 1/1983 Howerton et al.
4,437,371 A * 3/1984 Howerton ..... B26D 1/02 156/142
4,554,850 A 11/1985 Edgar et al.
4,753,007 A * 6/1988 Weller ..... H02G 1/1297 30/90.3
4,840,316 A * 6/1989 Barclay ..... B29B 17/02 241/279
4,876,792 A * 10/1989 Black ..... H02G 1/1297 30/90.9
4,972,583 A * 11/1990 Pinchon ..... H02G 1/1229 30/90.6
5,054,351 A * 10/1991 Jolliffe ..... B26D 3/005 83/430
5,234,382 A 8/1993 Fukuda et al.
2011/0010945 A1 * 1/2011 Delafosse ..... B26D 3/08 30/90.9
2011/0023668 A1 * 2/2011 McMahon ..... B26D 3/005 83/13

* cited by examiner

HAND-OPERATED ROTARY BELT CUTTER

TECHNICAL FIELD

The disclosed inventive concept relates to a portable hand tool and, more particularly, to a portable rotary belt cutter for use by the installer of a multi-ribbed transmission belt for an automotive vehicle. The portable rotary belt cutter is preferably a hand-operated rotary belt cutter that is hand-cranked. The belt cutter includes a rotary cutter that allows the operator to reduce a wide multi-ribbed belt to a desired width easily and efficiently.

BACKGROUND OF THE INVENTION

The engine of the automotive vehicle relied upon a flexible torque transmission belt for transmitting torque from the crankshaft to driven units since the earliest days of the automobile. The very earliest belts were endless flat belts formed from leather. Over time, the transmission belt took on a V-shape to avoid belt slippage. Later variations of the transmission belt include the toothed or cogged belt often used for timing.

Today, perhaps the most popular type of transmission belt used in the modern automotive vehicle is the multi-ribbed or V-ribbed belt. This belt is conventionally used to transmit torque from the engine's crankshaft to driven devices, such as the alternator, the power steering pump, the AC compressor, and the water pump. The multi-ribbed belt is manufactured as a very wide sleeve being approximately a meter wide and having perhaps 800 ribs. This sleeve is then cut into individual belts with each belt having a standard reduced rib count such as six ribs per belt. However, because the multi-ribbed belt has many uses in addition to the automotive industry, it is impossible for the manufacturer to reduce the initial wide sleeve to a belt width that finds universal application.

Accordingly, it is very common for the end user to find a belt close to the correct length for their application, but nonetheless have the wrong rib count. If a belt has more than the desired width and rib count, it can be cut down to fit the particular application.

However, cutting the multi-ribbed belt is not a simple undertaking as it is inherently structurally resilient and resistant to cutting. The multi-ribbed belt typically includes four generally distinct layers. These include a top or outer fabric layer that is conventionally composed of a polyester cotton canvas, a flat buffer or rubber supporting layer composed of a thermoset elastomer, tensile member layer composed of polyester or nylon to pass dynamic forces, and an inner layer defined by an array of parallel ribs also composed of a thermoset elastomer.

Because the multi-ribbed belt is subject to wear and is typically replaced as a precautionary measure in the repair shop when work is performed on any of the belt-driven components, it is necessary for a belt having the correct width to be readily available to the repair technician. However, at present there is no convenient tool, such as a hand tool, that allows an operator to accurately reduce the width and rib count of the belt by cutting it. Instead, the only tool used to cut belts by the repair technician is a box cutter or utility knife. In addition to presenting risk of injury to the operator, the box cutter and utility knife lack accuracy as the blade tends to follow the resilient tensile member layer that is internal to the belt and transverses the belt at an angle, thus resulting in a final product that varies in width.

Accordingly, known approaches to cutting a multi-ribbed belt to its appropriate width do not provide satisfactory results. As in so many areas of vehicle technology, there is always room for improvement related to tools and methods related to adapting a multi-ribbed transmission belt to a specific application.

SUMMARY OF THE INVENTION

The disclosed inventive concept provides a rotary cutter and method of accurately cutting a ribbed transmission belt lengthwise to a desired width. The rotary cutter includes an upper portion having a handle end and a pivot end and a lower portion having a handle end and a pivot end. The pivot ends of each portion are joined by a common pivot. A belt input pulley is attached to a rotatable upper body wheel extension. The pivotable upper body wheel extension and a rotary cutting wheel are rotatably attached to the upper portion. A biasing element such as a spring is fitted between the pivotable upper body wheel extension and the upper portion. A drive wheel is rotatably attached to the lower portion. A belt output pulley is rotatably attached to the common pivot. Preferably but not absolutely the belt input pulley and the belt output pulley have ribbed outer surfaces. A cutting wheel cover is fixed around at least a portion of the cutting wheel. The upper portion is movable between an open, belt-fitting position and a closed, belt-cutting position relative to the lower portion.

The rotary cutter of the disclosed inventive concept is preferably a hand-operated cutter but may be motorized by a corded or cordless electric motor as an alternative. In its manually-driven form, a hand crank is attached to the drive wheel. The drive wheel has a smooth outer surface but may have at least one cutting wheel groove formed therein.

The grooved pulleys mate with the ribs of the ribbed transmission belt to be cut, thereby maintaining its lateral position throughout the cutting process. The hand crank turns the drive wheel, thereby drawing the belt into the rotary cutter to cut the belt to the desired width. An adjustment knob can be used to for a fine adjustment of the lateral position of the rotary blade such that the overall final belt width can be adjusted.

While the rotary cutter of the disclosed inventive concept is particularly useful for allowing an automotive technician to cut a transmission belt to a desired size during vehicle repair, it is to be understood that the rotary cutter as discussed herein and as illustrated in the accompanying figures may be used cut any belt used for transferring rotary power. Non-limiting examples include table saws, cutting decks in lawn mowers, conveyers and compressors.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
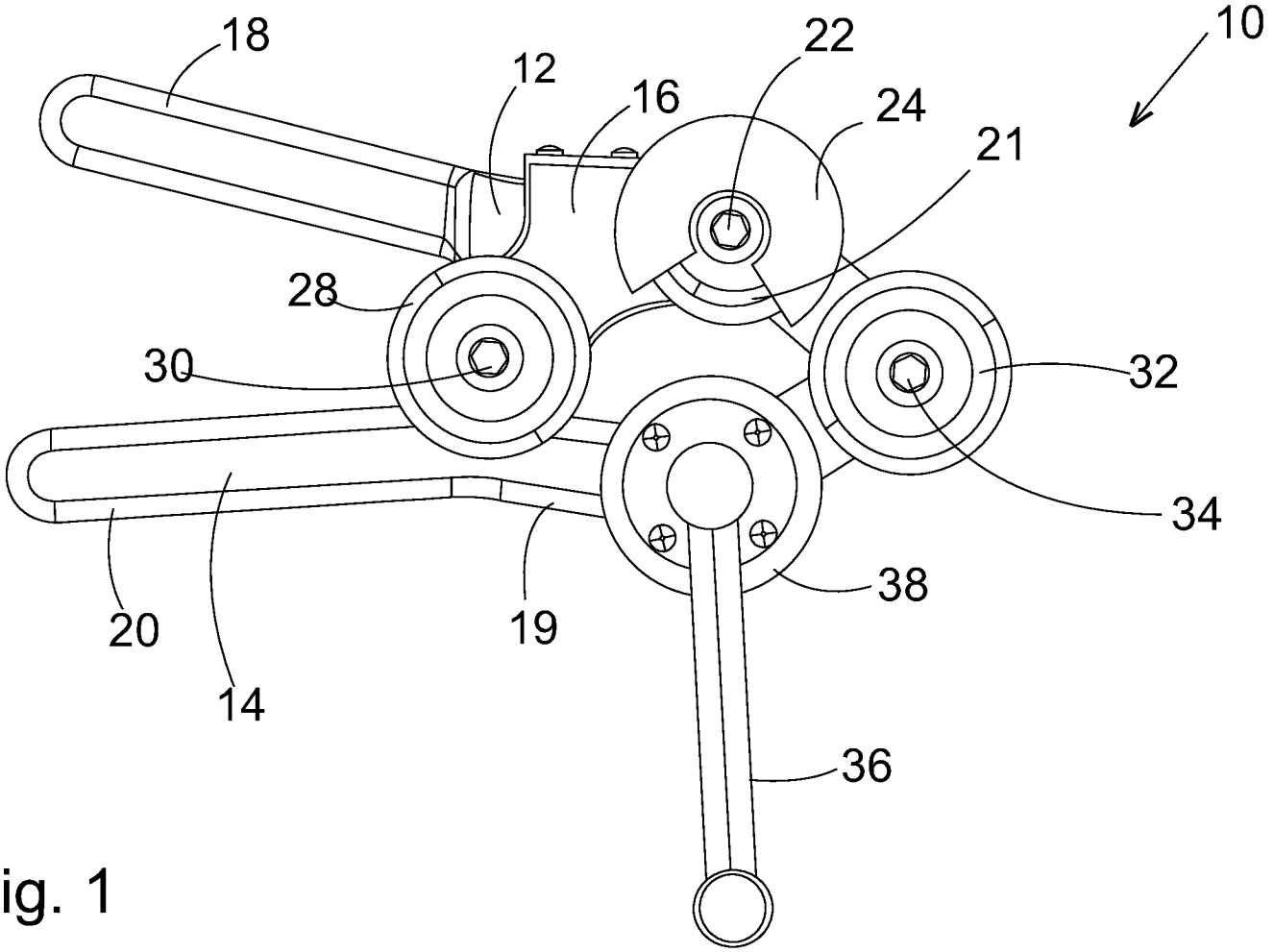
FIG. 1 is a front view of the hand-operated rotary belt cutter of the disclosed inventive concept illustrating the cutter in its closed position.

In the following figures, the same reference numerals will be used to refer to the same components. In the following description, various operating parameters and components are described for different constructed embodiments. These specific parameters and components are included as examples and are not meant to be limiting.

Figure 10:
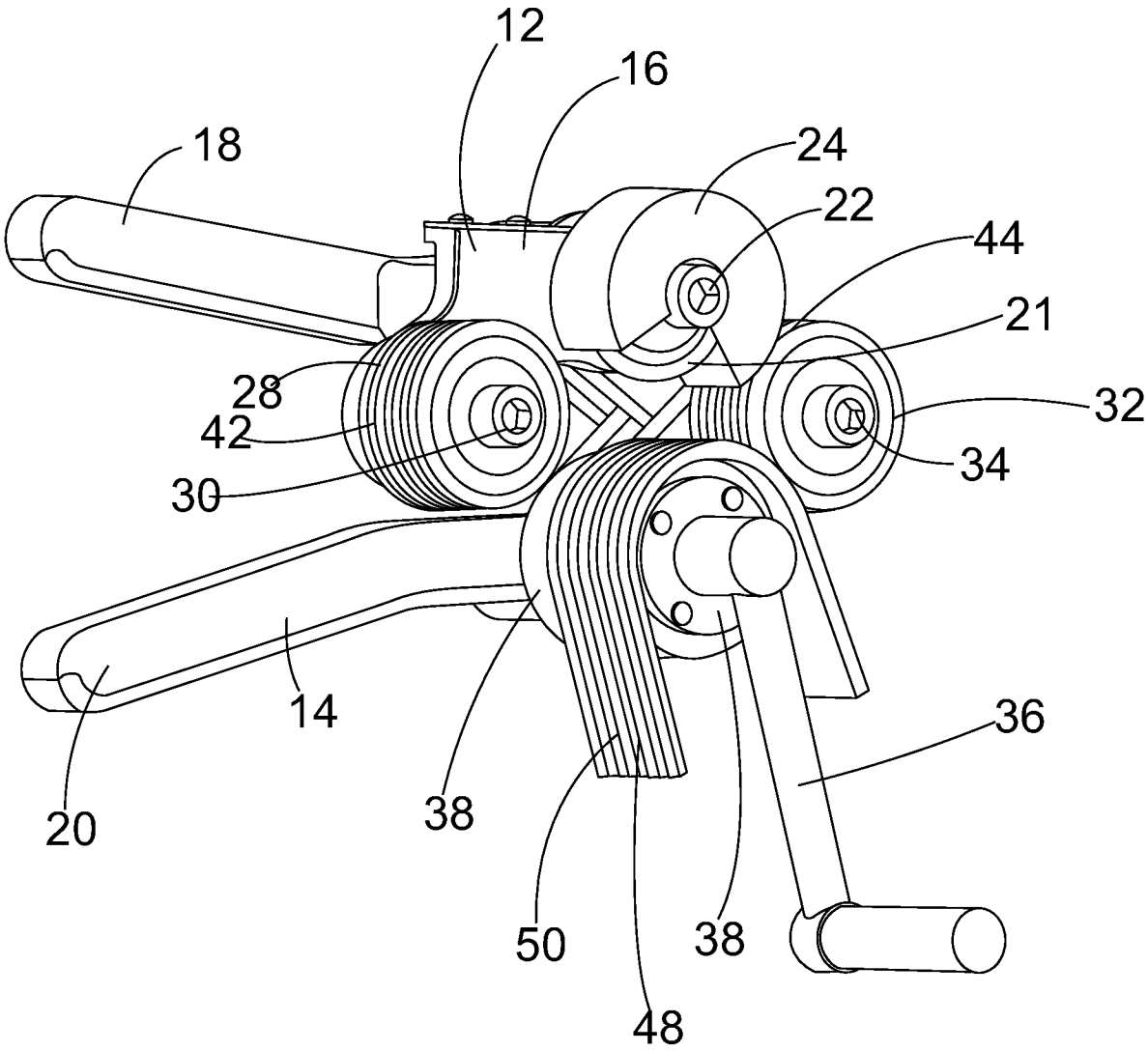
FIG. 10 is a perspective view of the rotary belt cutter of the disclosed inventive concept with a multi-ribbed belt mounted on the crank pulley before the cutter is moved to its closed position for cutting.
Figure 11:
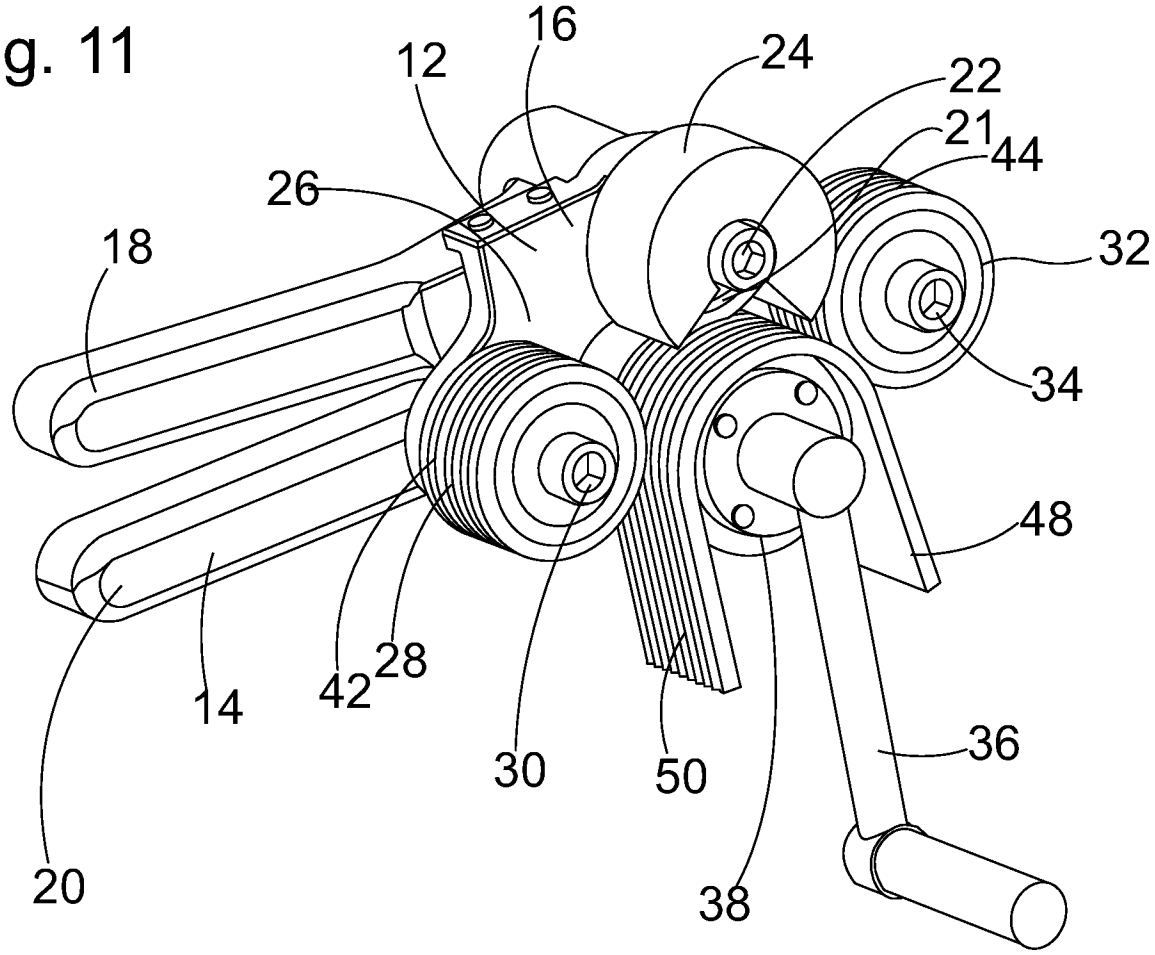
FIG. 11 is a perspective view of the rotary belt cutter of the disclosed inventive concept with a multi-ribbed belt mounted on the crank pulley after the cutter is moved to its closed position for cutting.

The accompanying figures and the associated description illustrate the hand-operated cutting tool of the disclosed inventive concept as well as its method of use. In general, FIGS. 1 through 9 are directed to various views of the hand-operated cutting tool of the disclosed inventive concept. The method of operating the hand-operated cutting tool of the disclosed inventive concept is illustrated in FIGS. 10 and 11. It is to be understood that the shape and size of the embodiment illustrated herein of the hand-operated cutting tool are not intended as being limiting but instead are intended as being suggestive as other shapes and sizes may be adopted without deviating from the spirit and scope of the disclosed inventive concept.

Figure 2:
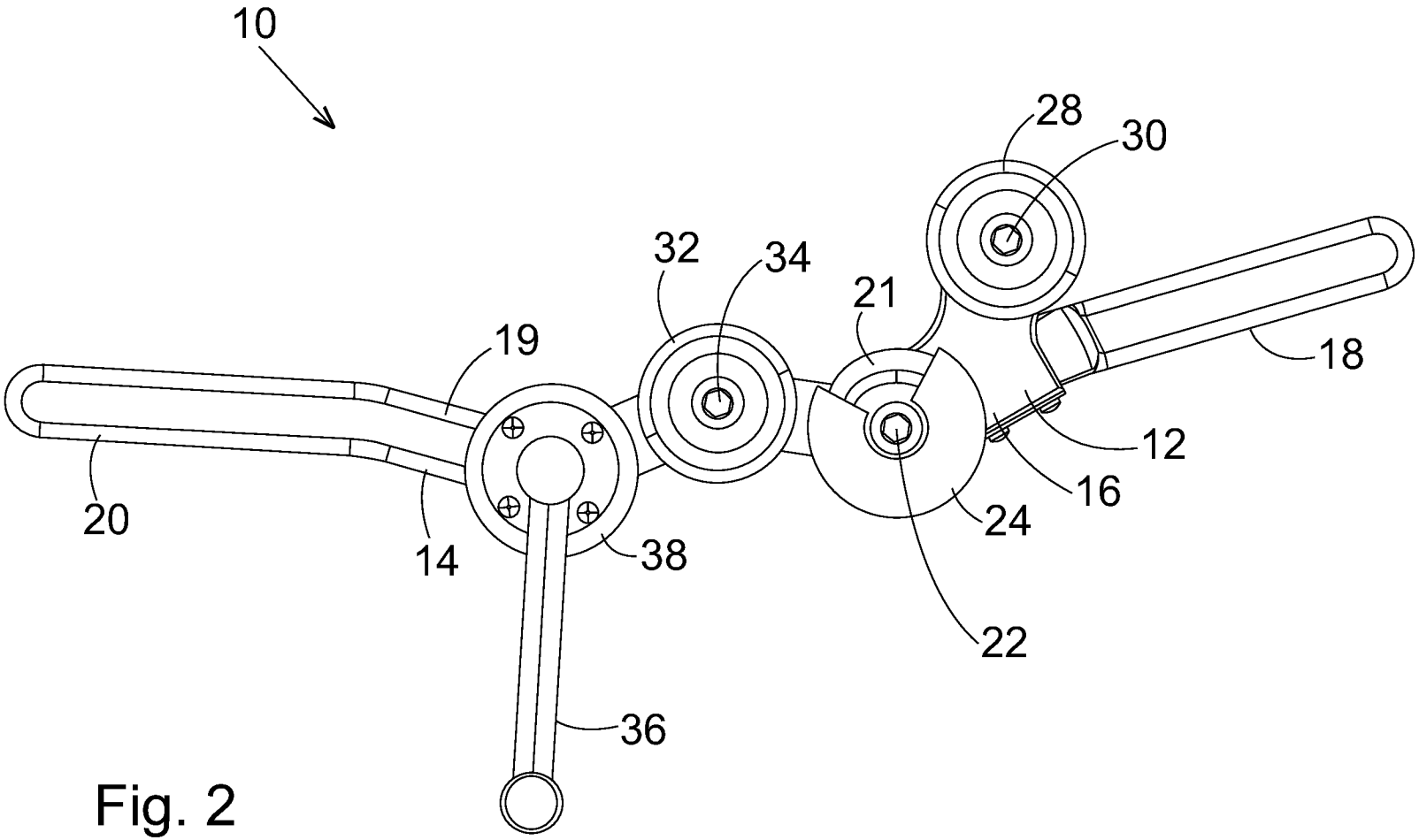
FIG. 2 is the same view as that of FIG. 1 but illustrating the cutter in its open position.
Figure 3:
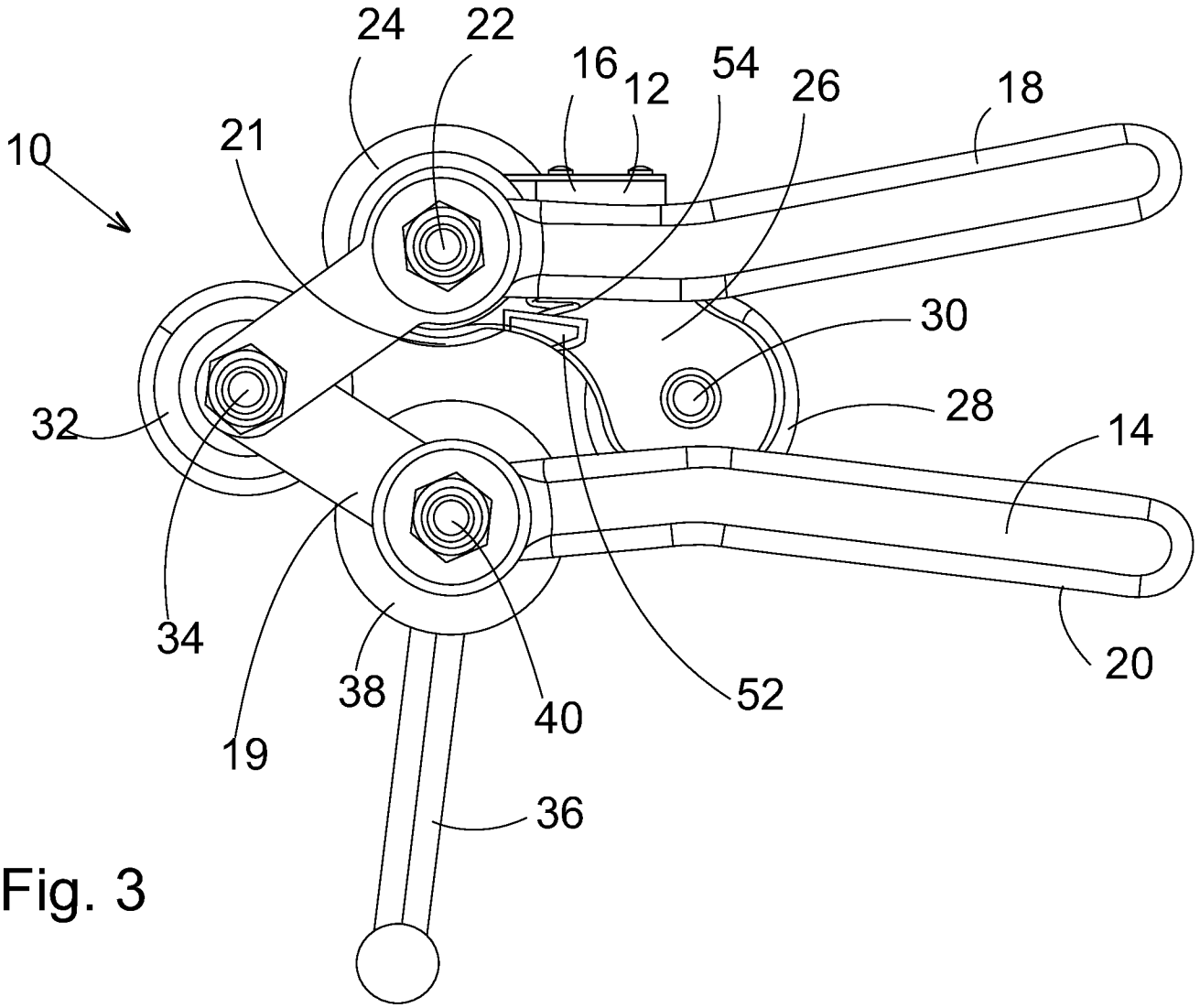
FIG. 3 is a back view of the rotary belt cutter of the disclosed inventive concept in its closed position.
Figure 4:
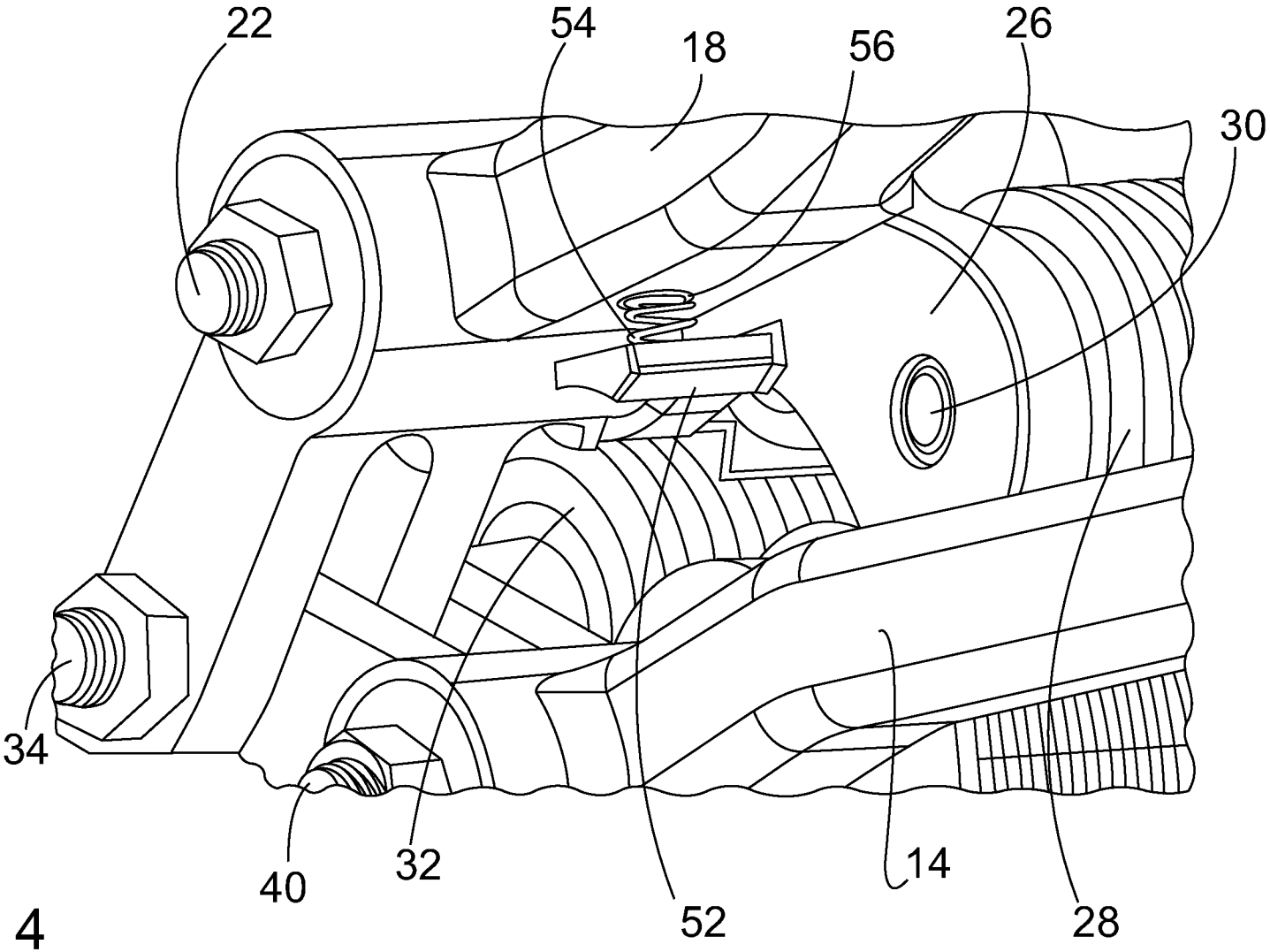
FIG. 4 is a close-up view of a portion of the rotary belt cutter detailing the construction of a biasing element in its extended condition.
Figure 5:
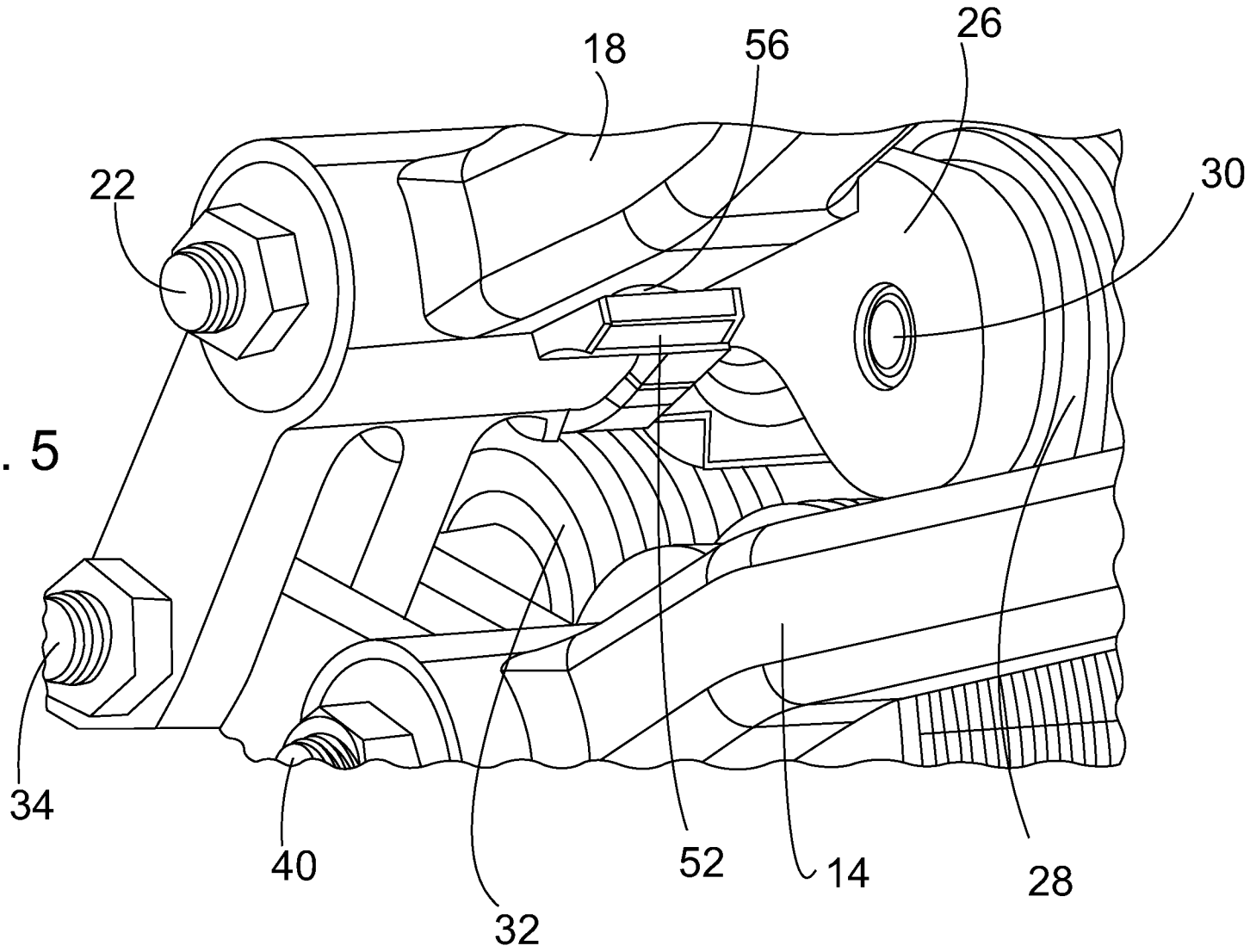
FIG. 5 is a view similar to that of FIG. 4 but illustrating the biasing element in its compressed condition.

Referring to FIGS. 1 and 2, various views of the hand-operated rotary belt cutter of the disclosed inventive concept are shown. The hand-operated rotary belt cutter, generally illustrated as 10, is shown in its closed position in FIG. 1 and in its open position in FIG. 2. Both FIGS. 1 and 2 illustrate side views of the hand-operated rotary belt cutter 10. When in its closed position as illustrated in FIG. 1, the hand-operated rotary belt cutter 10 is either stored or is in its belt cutting position. When in its open position as illustrated in FIG. 2, the hand-operated rotary belt cutter 10 allows placement of the belt for cutting.

Additional views of the hand-operated rotary belt cutter 10 are shown in FIGS. 3 through 9 in which a back view, a top view, close-up views of the extension biasing element, a first side view, a bottom view and a second side view are respectively illustrated.

Referring to FIGS. 1 through 9, the hand-operated rotary belt cutter 10 includes an upper portion 12 and a lower portion 14. The upper portion 12 and the lower portion 14 are pivotably connected as discussed below. The upper portion 12 includes an upper body 16 from which extends an elongated upper handle 18. The lower portion 14 includes a lower body 19 from which extends a lower handle 20. The upper body 16, its integrally associated elongated upper handle 18, the lower body 19, and its integrally associated elongated lower handle 20 may be formed from a number of materials including a metal or a rigid plastic. For example, and in the case of a metal, these components may be formed from aluminum. In the case of a plastic, these components may be formed from a carbon fiber reinforced polymer.

A rotary cutting wheel 21 is pivotably attached to the upper body 16 by a cutting wheel pivot 22 comprising a shaft attached to the upper body 16 by a conventional fastener such as a nut and bolt assembly. The rotary cutting wheel 21 is adjustably movable side-to-side on the bolt shank. As a non-limiting example, an adjustment knob (not shown) may be used for fine adjustment of the lateral position of the rotary cutting wheel 21 such that the overall final belt width can be pre-adjusted by the operator.

The rotary cutting wheel 21 includes a sharp peripheral edge that may be of the diamond edge variety. The sharp peripheral edge of the rotary cutting wheel 21 is sufficiently sharp so as to be able to cut completely through the ribbed belt. A cutting wheel cover 24 is provided and is fixed to the upper body 16. The cutting wheel cover 24 covers a substantial amount of the rotary cutting wheel 21 and, by doing so, protects the rotary cutting wheel 21 from damage and protects the operator from injury.

Pivotably attached to the upper body 16 is a pivotable upper body wheel extension 26. The pivotable upper body wheel extension 26 is pivotably attached to the upper body 16 by the cutting wheel pivot 22 thus allowing the pivotable upper body wheel extension 26 to pivot on the upper handle 18 around the centerline of the cutting wheel pivot 22. A grooved input pulley 28 is pivotably mounted on the pivotable upper body wheel extension 26 by a grooved input pulley pivot 30 preferably comprising a mechanical fastener such as a nut and bolt assembly. A grooved output pulley 32 is pivotably mounted to the joint formed between the upper portion 12 and the lower portion 14 by a common pivot 34. The common pivot 34 preferably comprises a mechanical fastener such as a nut and bolt assembly.

Operation of the hand-operated rotary belt cutter 10 is undertaken either manually, as illustrated, or may include a corded or cordless motor (not shown) for motorized operation. The manual version is illustrated in the figures. Particularly, the hand-operated rotary belt cutter 10 includes a hand crank assembly 36 having a drive wheel 38. The drive wheel 38 is attached to the lower body 19 by a crank pivot 40. The crank pivot 40 preferably comprises a mechanical fastener such as a nut and bolt assembly. It is to be understood that for the motorized version of the disclosed inventive concept a corded or cordless motor would be substituted for the hand crank assembly 36.

Figure 6:
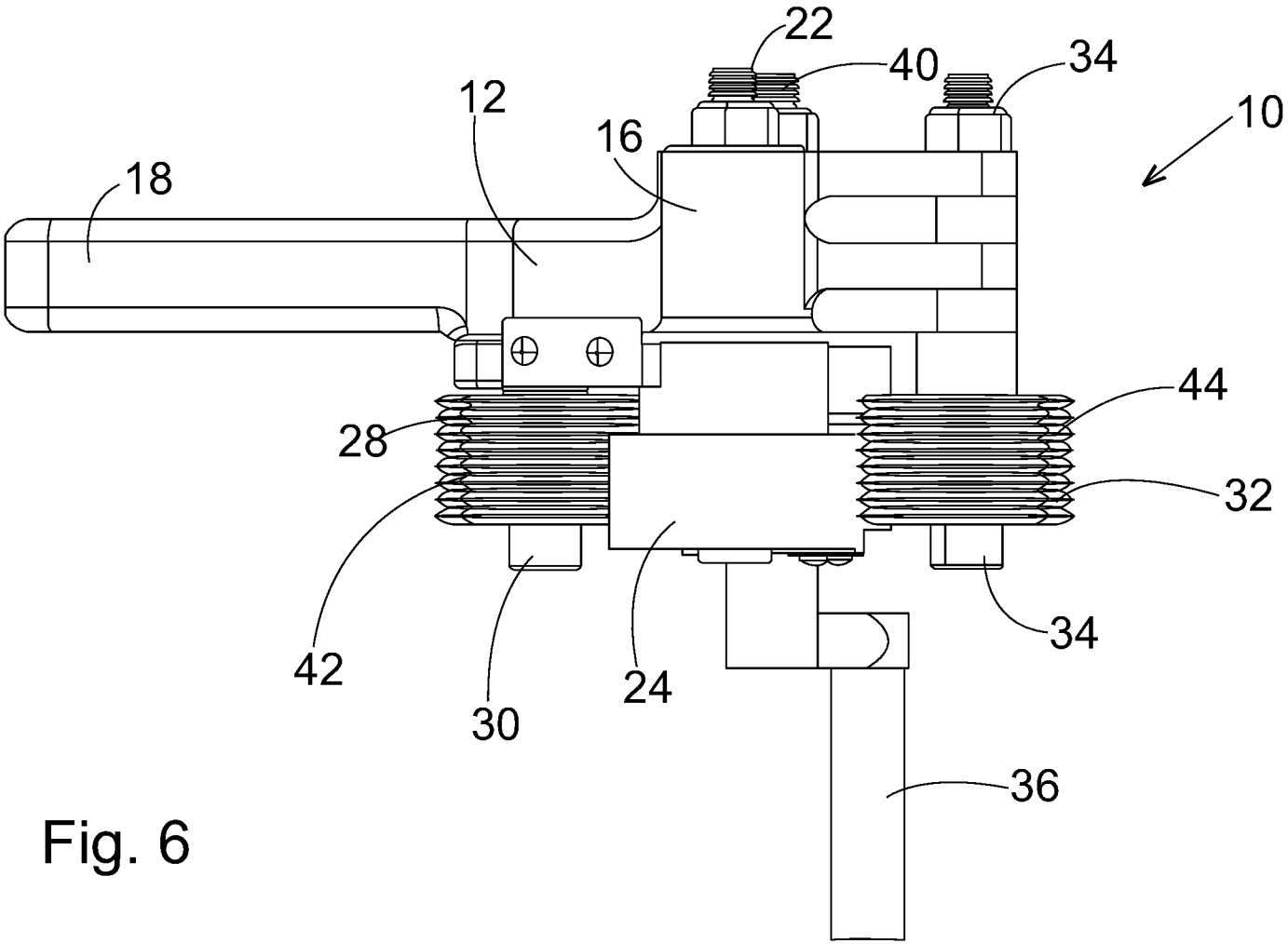
FIG. 6 is a top view of the rotary belt cutter of the disclosed inventive concept in its closed position.

The surfaces of the grooved input pulley 28 and the grooved output pulley 32 are well illustrated in FIG. 6. The surface of the grooved input pulley 28 includes a series of ribs 42 and the surface of the grooved output pulley 32 includes a series of ribs 44. The ribs 42 and 44 mate with the ribbed surface of the multi-ribbed belt, thereby maintaining lateral positions throughout the cutting process. A greater or lesser number of ribs 42 and 44 may be provided than the numbers illustrated. Both the number and width of the ribs 42 and 44 are dictated by the ribbed surface of the multi-ribbed belt to be cut.

Figure 7:
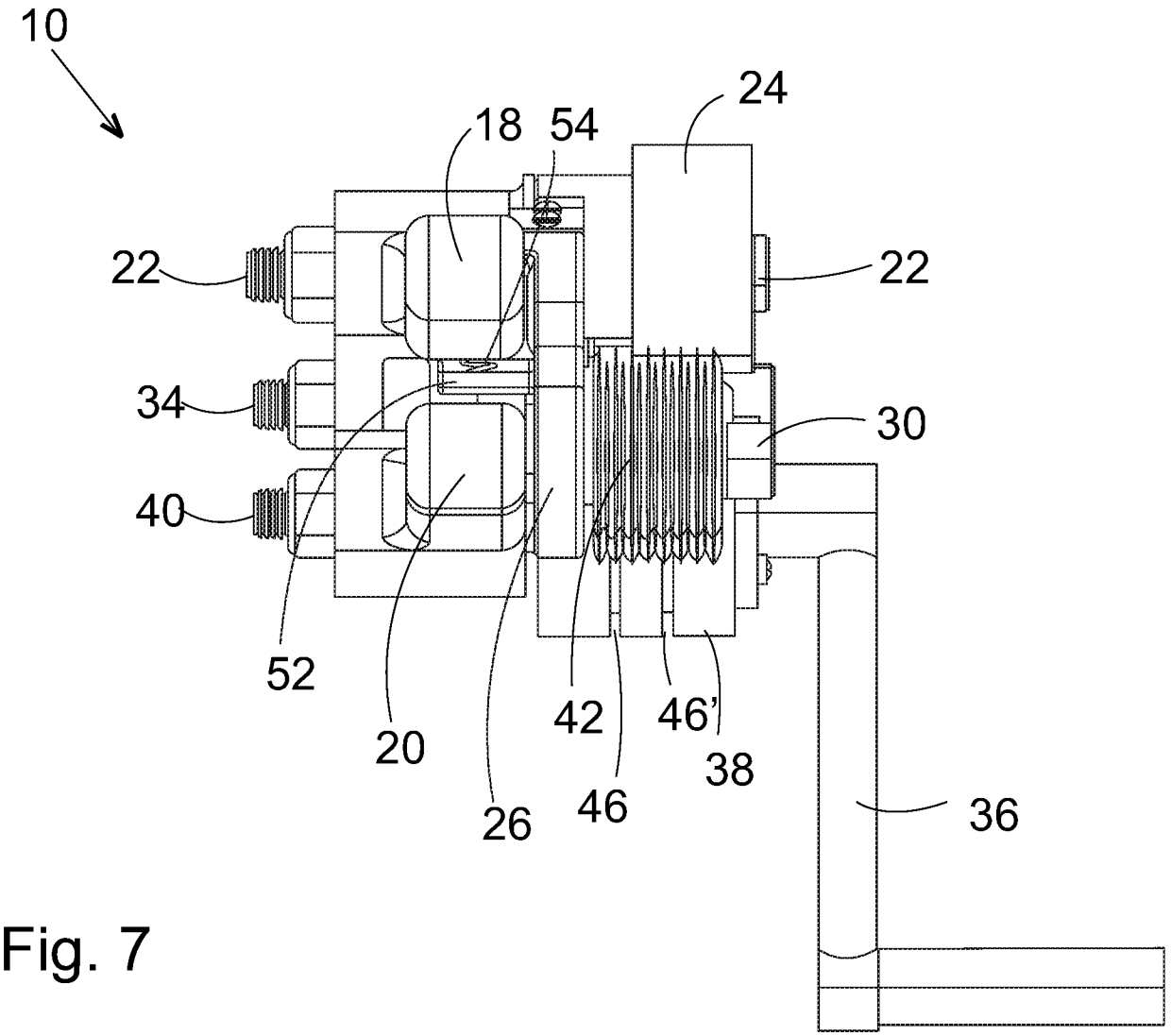
FIG. 7 is a first side view of the rotary belt cutter of the disclosed inventive concept in its closed position.
Figure 8:
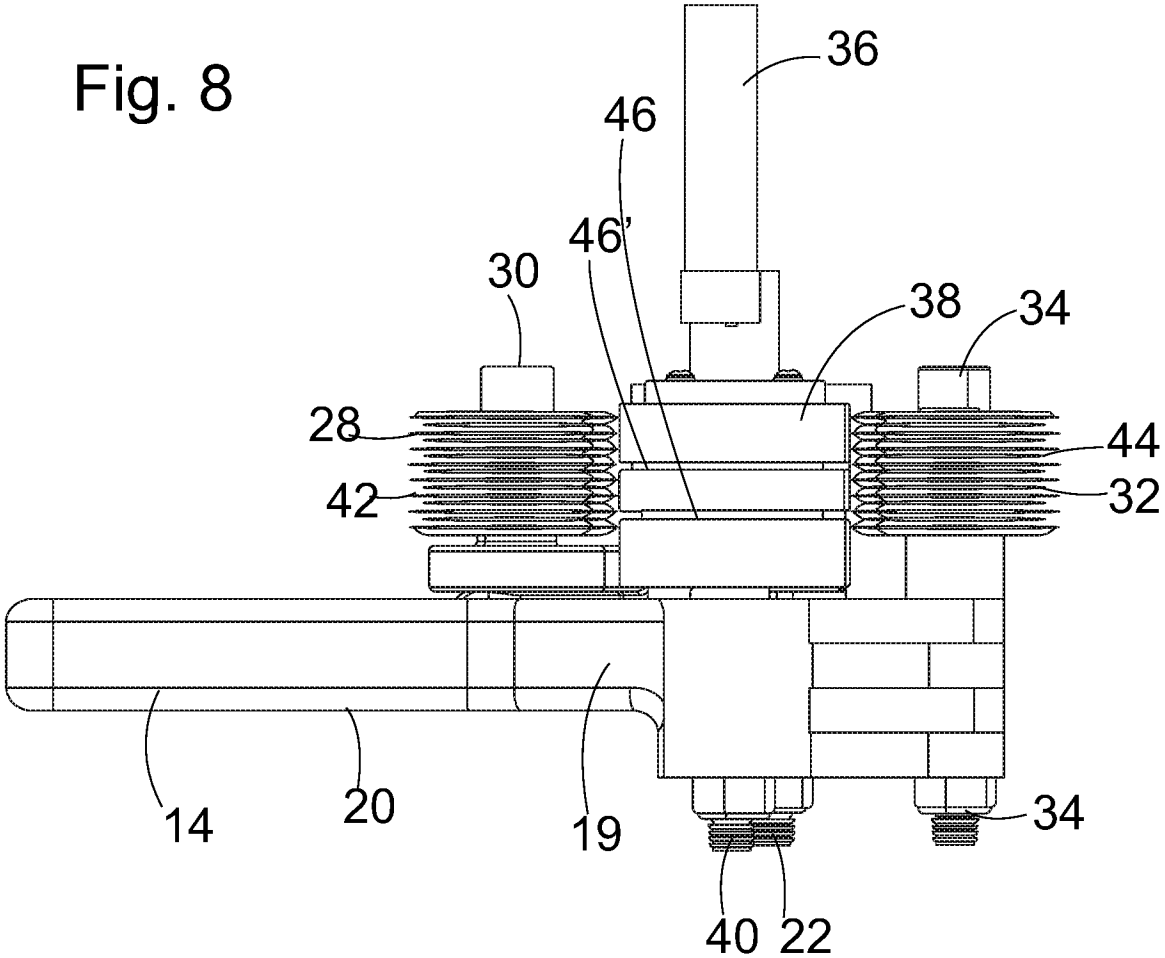
FIG. 8 is a bottom view of the rotary belt cutter of the disclosed inventive concept in its closed position.
Figure 9:
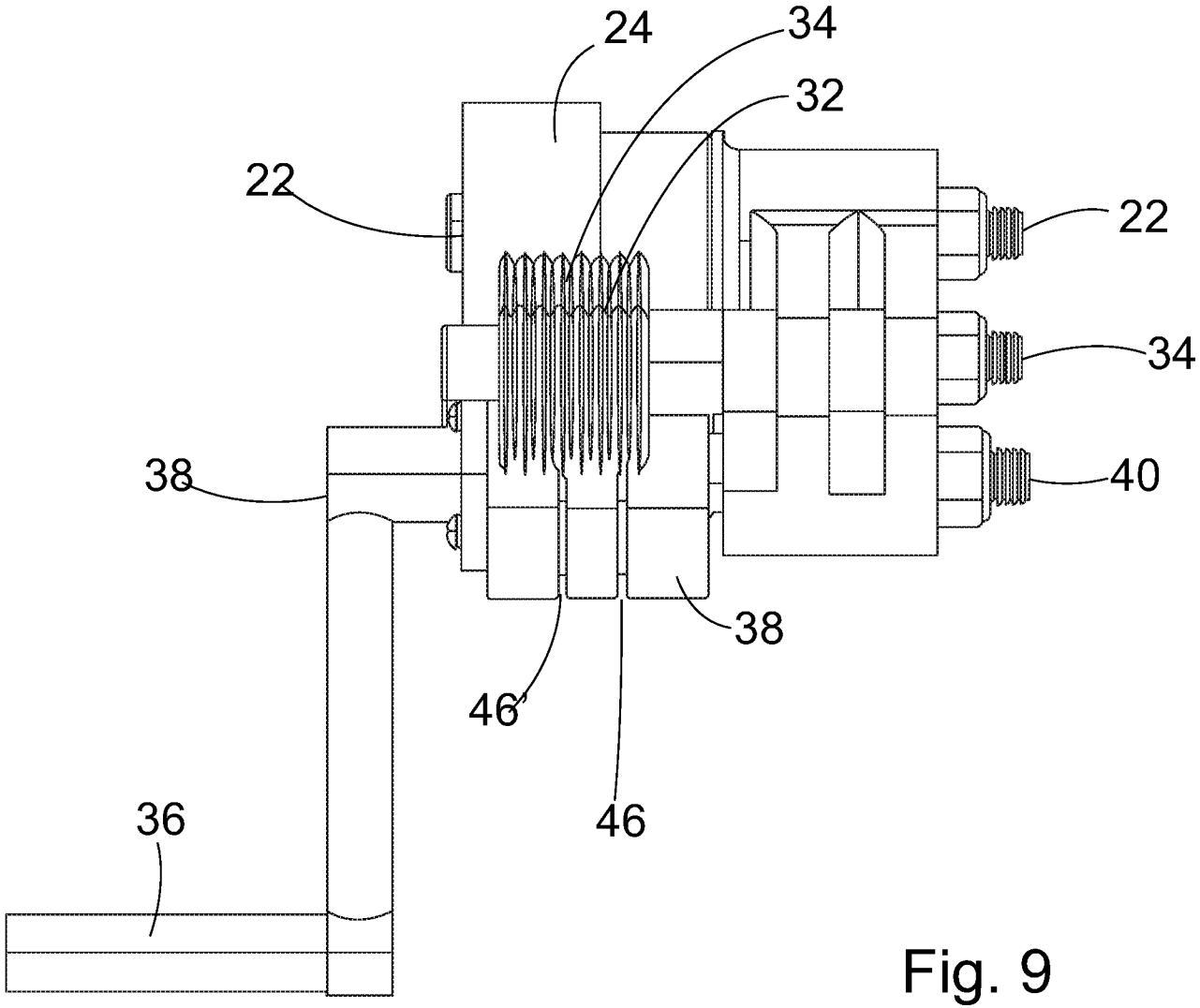
FIG. 9 is a second side view of the rotary belt cutter of the disclosed inventive concept in its closed position.

The drive wheel 38 includes at least one cutting wheel groove within which the peripheral edge of the rotary cutting wheel 21 is slotted. This arrangement allows for the belt being cut to be cut all the way through the belt by the rotary cutting wheel 21. According to the disclosed inventive concept, a pair of spaced-apart cutting wheel grooves 46 and 46' are formed in the face of the drive wheel 38 as illustrated in FIG. 7.

A biasing element perch 52 is integrally mated with the pivotable upper body wheel extension 26. A biasing element, such as a spring 54, is partially fitted in a spring pocket 56 formed in the upper body 16. The spring 54 is positioned between the upper body 16 and the pivotable upper body wheel extension 26. The spring 54 thus applies tension between the grooved input pulley 28 and the drive wheel 38. This arrangement is helpful in both the initial belt set up as well as in the cutting of the multi-ribbed belt 48 as noted hereafter.

In operation, the hand-operated rotary belt cutter 10 is first moved to its open position as illustrated in FIG. 2. A multi-ribbed belt 48 having a series of belt ribs 50 is positioned, smooth surface down, on the drive wheel 38. Thereafter, while the operator holds the lower handle 20 of the belt cutter 10 with one hand and the upper handle 18 with the other, the belt cutter 10 is moved to its initial, pre-cutting position as illustrated in FIG. 10. As illustrated in that figure, the multi-ribbed belt 48 is placed in its initial position with the ribs 42 of the grooved input pulley 28 and the ribs 44 of the grooved output pulley 32 in general alignment with the belt ribs 50 of the multi-ribbed belt 48. Tension is applied upon the multi-ribbed belt 48 by the grooved input pulley 28 so that it is securely held against the drive wheel 38 during the cutting operation. Fine adjustment of the position of the rotary cutting wheel 21 relative to the drive wheel 38 and its cutting wheel grooves 46 and 46' may be made as needed.

Once the multi-ribbed belt 48 is in its properly aligned position within the belt cutter 10, the operator closes the belt cutter 10 by moving the upper handle 18 and the lower handle 20 to their closest possible position relative to one another as illustrated in FIG. 11. This movement results in an initial cut being made between two adjacent belt ribs 50 of the multi-ribbed belt 48. The operator then clasps both the upper handle 18 and the lower handle 20 in one hand and grasps the handle of the hand crank assembly 36 with the other hand. By turning the hand crank assembly 36, the multi-ribbed belt 48 is fed into the belt cutter 10 with the grooved input pulley 28 and the grooved output pulley 32 serving to guide the multi-ribbed belt 48 as it passes into and through the belt cutter 10. The operator continues to turn the hand crank assembly until the entire belt is run through the belt cutter 10, thereby resulting in two belts, at least one of which having been cut to the desired width.

One skilled in the art will readily recognize from such discussion, and from the accompanying drawings and claims that various changes, modifications and variations can be made therein without departing from the true spirit and fair scope of the invention as defined by the following claims. It should also be noted that any component being denoted to as an "upper" component or a "lower" component is not intended to be limiting with respect to its position and may alternatively be interpreted as a "first" component or a "second" component, respectively. As a non-limiting example of a possible modification, a gauge or stop that enables the operator to know how many ribs or material are to be removed could readily be provided to the belt cutter as described and as illustrated in the accompanying figures.

What is claimed is:

1. A rotary cutter for cutting a belt, the cutter comprising:
a first portion having a handle end and a pivot end;
a second portion having a handle end and a pivot end, said pivot ends being joined by a common pivot;
a rotary cutting wheel rotatably attached to said first portion;
a wheel extension pivotably attached to said first portion;
an input pulley rotatably attached to said wheel extension;
a drive wheel rotatably attached to said second portion; and
an output pulley rotatably attached to said common pivot.

2. The rotary cutter of claim 1 wherein said input pulley has a ribbed surface and said output pulley has a ribbed surface.

3. The rotary cutter of claim 1 further including a hand crank attached to said drive wheel.

4. The rotary cutter of claim 1 wherein said drive wheel includes a smooth belt surface.

5. The rotary cutter of claim 4 wherein said smooth belt surface of said drive wheel includes at least one cutting wheel groove.

6. The rotary cutter of claim 1 further including a biasing element perch fixed to said wheel extension and a biasing element positioned between said biasing element perch and said first portion.

7. The rotary cutter of claim 1 wherein said first portion is movable between an open, belt-fitting position and a closed, belt-cutting position relative to said second portion.

8. A hand-operated rotary cutter for cutting a belt, the cutter comprising:
an a first portion having a handle end and a pivot end;
a second portion having a handle end and a pivot end, said pivot ends joined by a common pivot;
a rotary cutting wheel attached to said first portion;
a wheel extension pivotably attached to said first portion;
an input pulley rotatably attached to said wheel extension;
a drive wheel and hand crank assembly attached to said second portion; and
an output pulley attached to said common pivot.

9. The rotary cutter of claim 8 wherein said input pulley has a ribbed surface and said output pulley has a ribbed surface.

10. The rotary cutter of claim 8 wherein said drive wheel includes a smooth belt surface.

11. The rotary cutter of claim 10 wherein said smooth belt surface of said drive wheel includes at least one cutting wheel groove.

12. The rotary cutter of claim 8 further including a biasing element perch fixed to said wheel extension and a biasing element positioned between said biasing element and said first portion.

13. The rotary cutter of claim 8 wherein said first portion is movable between an open, belt-fitting position and a closed, belt-cutting position relative to said second portion.

14. A rotary cutter for cutting a ribbed transmission belt, the cutter comprising:
an a first portion having a handle end and a pivot end;
a second portion having a handle end and a pivot end, said pivot ends joined by a common pivot;
a rotary cutting wheel attached to said first portion;
a wheel extension pivotably attached to said first portion;
a ribbed input pulley rotatably attached to said wheel extension;
a drive wheel attached to said second portion; and
a ribbed output pulley attached to said common pivot.

15. The rotary cutter of claim 14 wherein said drive wheel includes a smooth belt surface having at least one cutting wheel groove.

16. The rotary cutter of claim 14 further including a biasing element perch fixed to said wheel extension and a biasing element positioned between said biasing element and said first portion.

17. The rotary cutter of claim 14 wherein said first portion is movable between an open, belt-fitting position and a closed, belt-cutting position relative to said second portion.

* * * * *